US005296038A

United States Patent [19]

Faxon

[11] Patent Number: 5,296,038

[45] Date of Patent: Mar. 22, 1994

[54] PROCESS AND ARRANGEMENT FOR CLEANING OF PIPE LINES

[76] Inventor: Johan Faxon, Box 3109, S-903 03 Umea, Sweden

[21] Appl. No.: 923,924

[22] PCT Filed: Mar. 8, 1991

[86] PCT No.: PCT/NO91/00036

§ 371 Date: Sep. 1, 1992

§ 102(e) Date: Sep. 1, 1992

[87] PCT Pub. No.: WO91/13699

PCT Pub. Date: Sep. 19, 1991

[30] Foreign Application Priority Data

| | | | |
|---|---|---|---|
| Mar. 9, 1990 | [SE] | Sweden | 9000837-6 |
| Apr. 9, 1990 | [SE] | Sweden | 9001282-4 |
| Feb. 19, 1991 | [SE] | Sweden | 9100486-1 |

[51] Int. Cl.[5] ..... B08B 9/00; B08B 9/02; B08B 9/04; B08B 5/02

[52] U.S. Cl. ..... 134/22.11; 134/22.12; 134/167 C; 134/172; 134/179

[58] Field of Search ..... 134/22.11, 22.12, 167 C, 134/172, 179

[56] References Cited

U.S. PATENT DOCUMENTS

| | | | |
|---|---|---|---|
| 1,587,194 | 6/1926 | Sladden | 134/167 C |
| 4,500,492 | 2/1985 | Yamakawa | 134/37 |
| 4,841,999 | 6/1989 | Danko | 134/22.12 |
| 5,003,998 | 4/1991 | Collett | 134/22.12 |
| 5,143,105 | 9/1992 | Katayama | 134/179 |

FOREIGN PATENT DOCUMENTS

| | | |
|---|---|---|
| 805209 | 5/1951 | Fed. Rep. of Germany . |
| 41358 | 5/1925 | Norway . |

*Primary Examiner*—R. Bruce Breneman
*Assistant Examiner*—Zeinab El-Arini
*Attorney, Agent, or Firm*—Watson, Cole, Grindle & Watson

[57] ABSTRACT

There is mentioned a process and an arrangement for cleaning of pipelines, and especially ventilation pipes and ventilation ducts in buildings, by means of a largely spherical cleaning means (1) which is connected via a supply conduit (2) with a source of pressure medium, and which exhibits a nozzle opening in the form of a largely continuous annular gap (6) which extends along the periphery of the cleaning means (1) and which is connected to the supply conduit (2) and the source of pressure medium. The medium is made to discharge through the annular gap (6) in order partly to clean inner walls of the line, and partly, as a result of the forces of reaction from the discharging medium, to make the cleaning means (1) move into the pipeline. The cleaning means (1) is brought into contact with an inner wall of the line in that a reduced pressure is established between the cleaning means (1) and the inner wall and it is made to move around about the cross-section of the line by twisting of the supply conduit.

10 Claims, 2 Drawing Sheets

FIG. 5
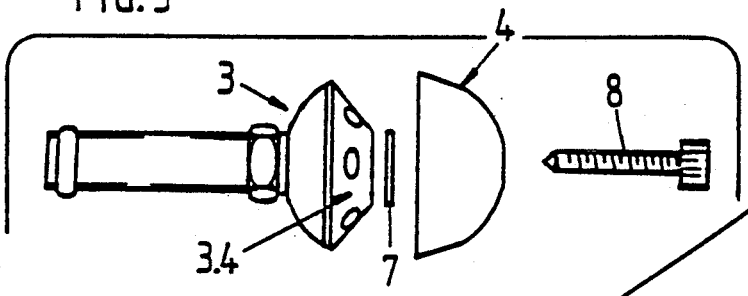
FIG. 6
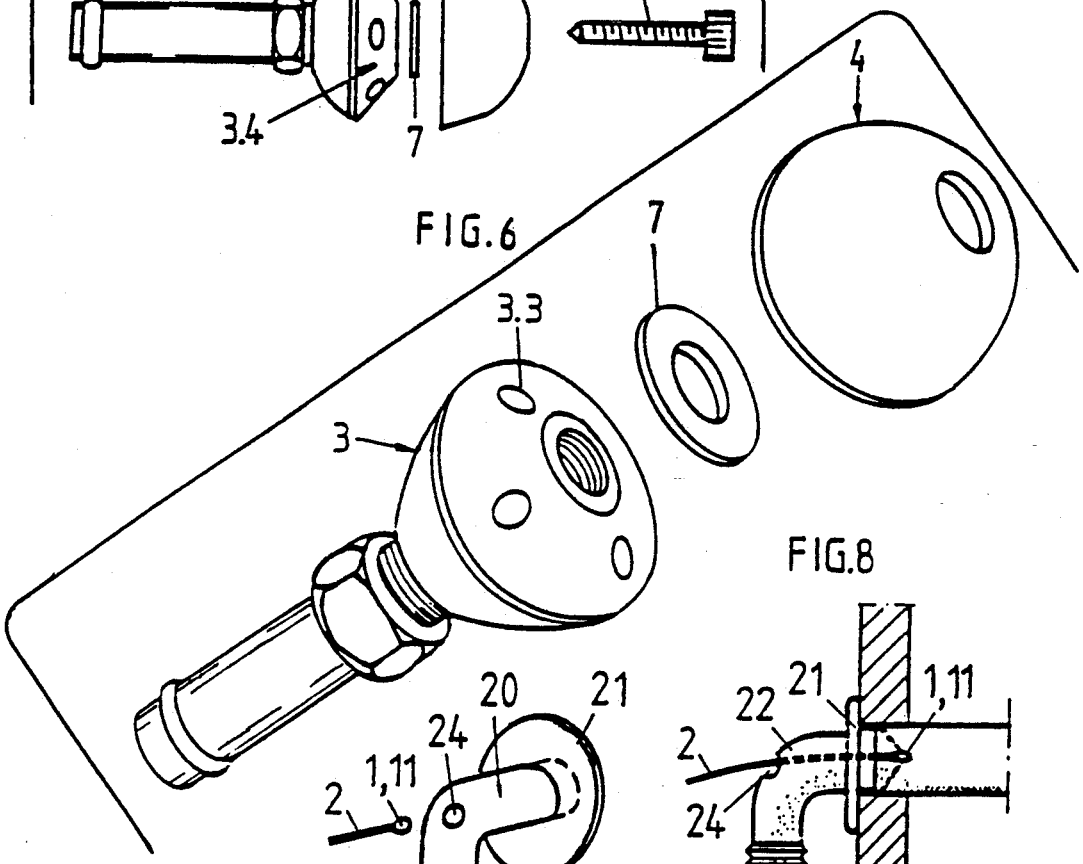
FIG. 8
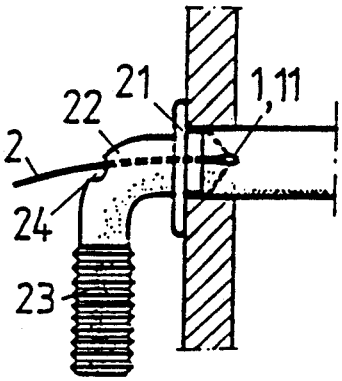
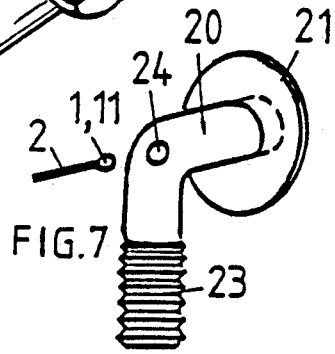
FIG. 7
FIG. 9
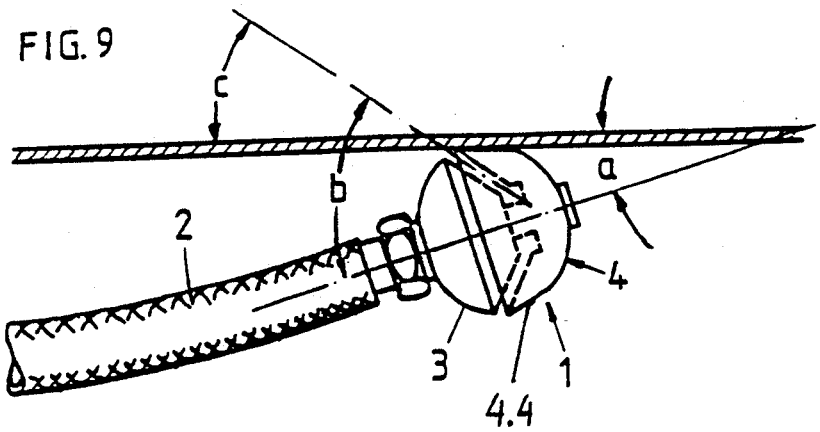

PROCESS AND ARRANGEMENT FOR CLEANING OF PIPE LINES

BACKGROUND OF THE INVENTION

The present invention relates to a process for cleaning of pipe lines, especially ventilation pipes and ventilation ducts of large cross-sectional area, in buildings, by means of a cleaning means, which is connected via a supply conduit to a source of pressure medium, for example a compressed air compressor, and which cleaning means exhibits one or more nozzle openings which are directed backwards towards the supply conduit at an acute angle relative to a centre line which extends through the fastening of the supply conduit in the cleaning means. The present invention is also relates to a nozzle opening in the form of a mainly continuous annular gap, which extends along the periphery of the cleaning means and which is connected to the supply conduit and the source of pressure medium, the medium being made to discharge through the annular gap and partly clean inner walls of the line, and partly, by way of forces of reaction from the discharging medium, make the cleaning means move into the pipe line.

The invention also relates to a cleaning arrangement for carrying out the process, comprising a cleaning means in the form of a rear piece, and a front piece detachably mounted on the rear piece, for providing a nozzle opening in the form of a mainly continous annular gap which is directed backwards towards the supply conduit at an acute angle towards a centre line which extends through the fastening of a supply conduit in the cleaning means, and the cleaning means is connected to a source of pressure medium via the supply conduit.

Norwegian Patent No. 41.358. discloses a nozzle head for cleaning pipes and passageways. The nozzle head which comprises an annular continous gap near the periphery of the head, is connected to a hose supplying pressure fluid, and the fluid is directed backwards through the gap to clean the pipe and move the nozzle head further along the pipe. However, the nozzle head of this prior art is intended and designed also to rotate and to float about the middle of the pipe in effecting the cleaning operation. Thus it is not intended to be in close contact with the pipe inner wall as is the case with the present invention. Another example of this kind of cleaning nozzle head is known from U.S. Pat. No. 1,587,194.

SUMMARY OF THE INVENTION

The object of the present invention is to provide a process and an arrangement, which produce a satisfactory cleaning of pipe lines of loose dust, deposits and other contaminants plus disinfection of the lines also. The invention primarily aims to provide cleaning of ventilation pipes and ventilation ducts of large cross-sectional surface, but being able to clean of contaminants all types of conduits having dissimilar cross-sectional forms also lies within the scope of the invention.

These objectives are achieved with the process of the present invention which is characterised in that the cleaning means is brought into contact with an inner wall of the line in that a reduced pressure is established between the cleaning means and the inner wall and that the cleaning means is made to move around about the cross-section of the line by twisting the supply conduit about its longitudinal axis. This reduced pressure is preferably established by bringing the annular gap on the cleaning means into close contact with inner wall of the line and especially by adjusting the cleaning means to assume an angle against inner wall of the line.

The cleaning arrangement of the present invention is characterised in that the cleaning means has largely the shape of a ball wherein the continuous gap extends along the outermost periphery of the cleaning means, said continous gap is established by the back piece exhibiting an external conical surface extending along its periphery at its forward end, while the front piece presenting a conical internal surface corresponding to said back piece conical surface in order to, when used, establishing said annular gap and said annular gap being directed back out towards the coupling means at an angle of up to 30–60 degrees.

The remaining characterizing features of the process and the cleaning arrangement of the invention will be evident from the claims.

The before mentioned prior art patent apparatuses are not able nor intended to operate in close contact with the pipe inner wall like the cleaning means of the present invention. The main feature for obtaining this close contact effect with the present invention seems to be the different new, and specific ball surface area design of the nozzle head. One further important feature is that the length of the gap defined by the conical back and front pieces respectively of the present invention, seems to extand a longer distance than the compared gaps of the prior art nozzle heads, leading to a more concentrated fluid spray from the gap in the nozzle head. These seem to be the main conditions for establishing the reduced pressure between the cleaning means and the pipe inner wall.

On cleaning a pipe line, a coupling arrangement is arranged on an inspection opening, exhaust valve or the like, which seals against the opening in the pipe line. A cleaning means according to the invention which is arranged in the one end of a flexible hose, is introduced through an insertion opening in the coupling arrangement and into the pipe line. The coupling arrangement is coupled by means of a conduit to a vacuum cleaner arrangement or the like, which is utilised to establish a reduced pressure in the pipe line. A pressure medium, for example, compressed air or steam, is fed to the cleaning means and thereby causes the cleaning means to move into the pipe line into contact with its inner wall and convey with it the supply conduit for the pressure medium, so that as a consequence of the high speed of discharge, the outflowing medium loosens dust, deposits and other contaminants on the inner wall of the pipe line. The dust or the deposits are thereafter sucked out by means of the vacuum cleaner arrangement.

Surprisingly it has been found that the cleaning means can be maintained in contact with each and all walls of the pipe line, that is to say even largely vertical walls as well as ceilings, as a consequence of the reduced pressure which is formed between the wall and the cleaning means when the annular gap of the cleaning means is brought into direct contact with a wall of the line. This involves having to arrange the annular gap at the outermost periphery of the cleaning means for it to be able to be brought into such a contact with the wall in question. The cleaning means must consequently have a shape which makes this possible, such as for example a shape of a ball or two double conical elements which are joined together at their bottom portions or of another symmetrical form where the annular gap can be arranged along an outer periphery.

It has been found practical to conduct the cleaning in several steps, the first step consisting in making the cleaning means move through the pipe line during feeding of a solvent. In this step the primary objective is not to loosen dust and detach deposits in the pipe line by means of the mechanical finishing ability of the air, but to feed a cleaning agent which contributes to the solubility of the deposits. The second step consists in making the cleaning means move through the pipe line under full pressure of the pressure medium, the speed of the cleaning means being regulated by braking the introduction of the supply conduit in the pipe line. The dust and the deposits are consequently released by means of the cutting action which is produced by the medium which discharges from the annular gap on the cleaning means, but also as a consequence of the irregular movements of the cleaning means and impacts against inner walls of the pipe line, and especially if the latter has a cross-section with sharp corners, such as for example with a rectangular or square cross-section. In spite of the occurrence of possible sharp corners the cleaning means can be made to move around in the cross-section as a result of the above described twisting of the supply conduit. Preferably the supply conduit is made to twist cyclically a number of rotations first in one direction and thereafter in an equal number of turns in the opposite direction during the course of cleaning. When the cleaning means is introduced to a desired position in the pipe line the supply of pressure medium is cut off so that the cleaning means can be drawn out of the pipe line without needing to overcome the force of reaction from the medium which discharges from the annular gap. Alternatively the medium can be caused to discharge from the annular gap at a lower speed when the cleaning means is to be drawn out of the pipe line.

On cleaning of ventilation pipes and ventilation ducts in buildings pressure medium is preferably utilised in the form of air which can be mixed with solvent or disinfectant in the dissimilar cleaning steps. Even steam can be utilised as pressure medium since the breadth of the annular gap in the cleaning means can be reduced and produces a smaller discharge from the annular gap compared with the case where compressed air is utilised. It also lies within the scope of the invention to be able to combine the utilisation of compressed air and steam since the solvent and disinfectant can be fed to the pipeline by means of compressed air while the actual cleaning is carried out by means of steam at high pressure, for example at 180 kp/square cm.

Further features and advantages of the cleaning means according to the invention are evident from an embodiment described subsequently.

BRIEF DESCRIPTION OF THE DRAWINGS

The invention will be described in the following text in the form of an embodiment in combination with the accompanying drawings, wherein:

FIG. 5 shows a side view of the cleaning nozzle according to FIG. 4.

FIG. 6 shows a perspective view of the cleaning nozzle according to FIG. 5.

FIGS. 7 and 8 show the utilisation of the cleaning arrangement during cleaning of a ventilation duct.

FIG. 9 shows an alternative construction of the cleaning nozzle which is arranged at a horizontal ceiling in a duct of rectangular cross-section.

DETAILED DESCRIPTION OF PREFERRED EMBODIMENTS

Figure 1:
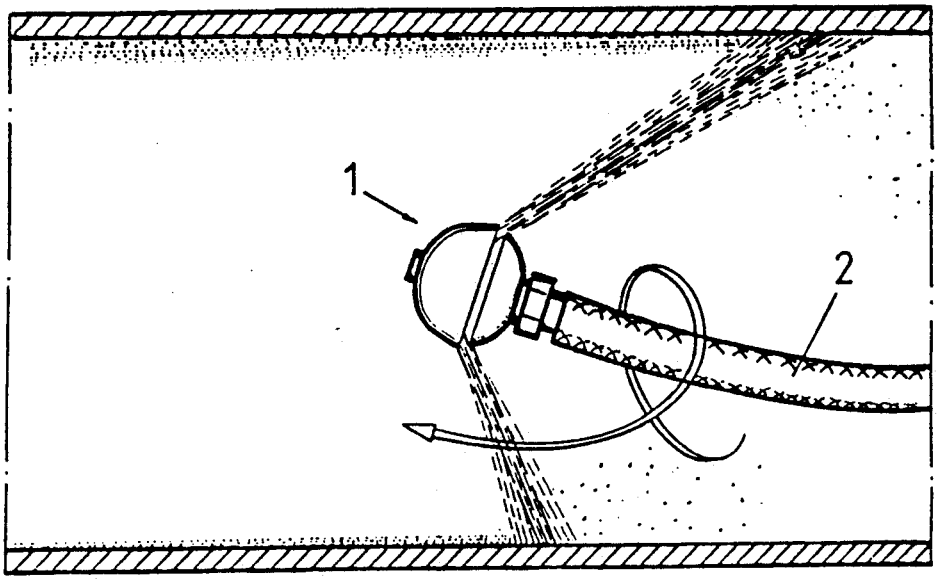
FIG. 1 shows a cleaning arrangement according to the invention in operation in a pipe-shaped duct illustrated in one longitudinal section, and where a cleaning means in the arrangement bears against an inner wall of the duct.
Figure 2:
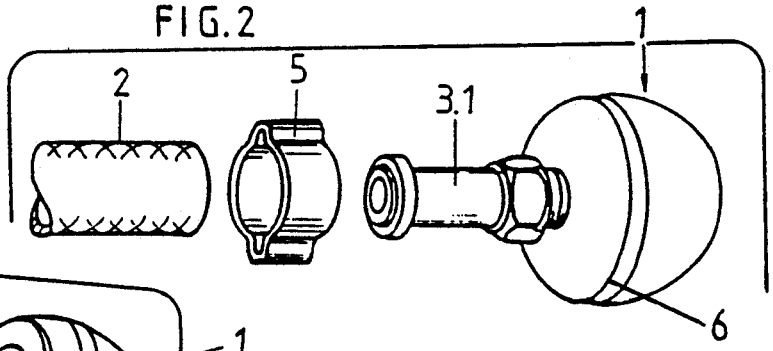
FIG. 2 shows a cleaning nozzle in the arrangement according to FIG. 1 which is adapted for coupling of a hose.
Figure 3:
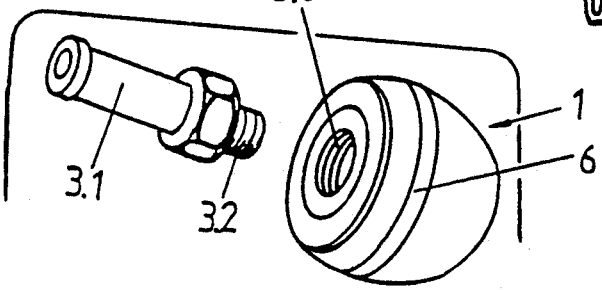
FIG. 3 shows an alternative construction of the hose coupling according to FIG. 2.
Figure 4:
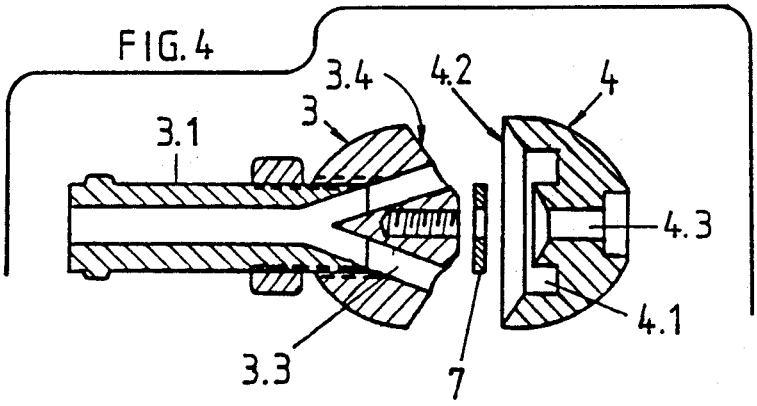
FIG. 4 shows a longitudinal section through the cleaning nozzle according to FIG. 2, and partly dissassembled.

The cleaning arrangement which is illustrated in FIG. 1–6 comprises a cleaning nozzle 1, which is fixedly arranged in the end of a flexible hose 2 for feeding compressed air to the nozzle. The hose 2 is fastened on the cleaning nozzle 1 by means of a hose clamp 3. The parts are shown disassembled in FIG. 2. In FIG. 1 the cleaning arrangement is shown inserted in a pipe-shaped duct where dust and deposits are to be removed from walls of the duct. The cleaning nozzle 1 includes a rear piece 3 and a front piece 4 dismantleable from this. The rear piece 3 is provided with a coupling pipe 3.1 which the hose is secured to by means of a hose clamp 5. The coupling pipe 3.1 can constitute an integrated portion of the rear piece 3, such as is shown for example in FIG. 2 and 4, or it can be secured with a suitable pin 3.2 such as is shown in FIG. 3. The rear piece 3 exhibits four distribution holes 3.3 which are arranged symmetrically about its central axis, something which for one thing is evident from FIG. 6, and the holes 3.3 are connected to the coupling pipe 3.1 and discharge into the forward end of the rear piece directed towards the front piece 4. The front piece 4 which largely has the shape of a hemisphere shows a mixing chamber 4.1 which extends symmetrically about its central axis and which has the same radius which the distribution holes 3.3 are arranged with around the axis. The function of the mixing chamber 4.1 will be described further below. The rear piece 3 furthermore presents an external conical surface 3.4, which extends along its periphery at its front end, and which corresponds to an internal conical surface 4.2 on the front piece, the assembled cleaning nozzle 1 exhibiting an annular gap along the periphery of the nozzle which is directed back out towards the coupling piece 3.1. The breadth of the annular gap 6 can be regulated by means of a washer 7 the thickness of which determines the breadth of the gap so that the thicker washer 7 gives a broader annular gap 6. The front piece 4 is fixedly mounted on the rear piece 3 by means of a screw 8 which passes through a central hole 4.3 in the front piece 4 and is screwed into a threaded hole 3.5 in the rear piece 3.

During cleaning of a pipe-shaped ventilation duct, such as is shown in FIG. 1, an exhaust valve for example is replaced with a coupling arrangement 20 as is illustrated in FIG. 7 and 8. The coupling arrangement 20 presents a flange 21 sealed against a wall and a bent pipe 22 projecting outwardly from the flange to which there is coupled a suction hose which connects the bent pipe to a vacuum cleaner arrangement or the like. The bent pipe 22 shows an insert opening 24 situated in the extension of the centre line to the horizontal portion of the bent pipe 22 in FIG. 7 and 8, and through the opening is inserted the cleaning nozzle 1 with the hose 2. The cleaning operation consists in that the cleaning nozzle 1 after the insertion in the ventilation duct which is to be cleaned, is fed with compressed air which if desired is fed with a cleaning agent and/or a disinfectant. At high speed compressed air consequently discharges back out from the annular gap along the periphery of the cleaning nozzle 1, so that the nozzle is driven into the duct as a result of the forces of reaction from the discharging air, and carries the hose 2 with it. The cleaning nozzle 1 bears against inner wall of the duct and is manoeuvred in a lateral direction in that the hose is twisted to the one side or the other. Simultaneously the suction hose 23 is placed under reduced pressure so that dust which is released from inner walls of the duct is sucked away from the duct and is collected in the vacuum cleaner arrangement which moreover is not shown in the Figures. Dust and existing deposits are released from inner walls of the duct partly as a result of the cutting effect which is produced by the air discharging from the annular gap 6, and partly as a result of irregular movements of the cleaning nozzle 1 and impacts against inner walls of the duct.

As a result of the reduced pressure which is formed at the inner wall directly against the annular gap 6 the cleaning nozzle 1 is held firmly against inner walls of the duct and can be manoeuvred forwardly to each and all inner surfaces in the duct independently of the cross-sectional form of the duct, that is to say both along largely vertical side surfaces in the duct and surfaces which form ceilings of the duct.

An alternative construction of the cleaning nozzle 1 as shown in FIG. 9 has substantially the same spherical shape as the construction which is evident from FIG. 1–6, but shows beyond this a conical portion 4.4 on the front piece 4 closest in to the annular gap 6. The conical portion 4.4 shows a cone angle of a=15 degrees, but it can be between 10–40 degrees. If, as shown in the example, the conical surfaces 3.4, 4.2, which lead forwards to the annular gap 6 incline with a gap angle b=50 degrees the air discharging from the annular gap 6 will be directed with an impact angle c=35 degrees towards the ceiling surface which the cleaning nozzle 1 bears against. The gap angle b can be 30–60 degrees. The impart angle c can vary within the region 5–40 degrees, preferably 10–20 degrees, by selection of the cone angle a and/or the gap angle b depending upon which type of duct the cleaning nozzle 1 is intended to treat and depending on the type of pressure medium and of possible cleaning agent which is to be utilised. The conical portion 4.4 on the front piece 4 thus stabilises the cleaning nozzle 1 into abutment with the surface in question and prevents the cleaning nozzle 1 from swinging forwards and backwards in its longidutinal direction something which can reduce the result of the cleaning. It is also preferred to employ a relatively soft hose 2 for feeding compressed air to the cleaning nozzle 1.

I claim:

1. Process for cleaning pipe lines, especially ventilation pipes and ventilation ducts in buildings, by means of a cleaning means, which is connected via a supply conduit to a source of pressure medium, and which exhibits one or more nozzle openings which are directed backwards toward the supply conduit at an acute angle relative to a center line which extends through the fastening of the supply conduit in the cleaning means, said nozzle opening in the form of a mainly continuous annular gap, which extends along the periphery of the cleaning means and which is connected to the supply conduit and the source of the pressure medium, the medium being made to discharge through the annular gap and partly clean inner walls of the line, and partly, by way of forces of reaction from the discharging medium, make the cleaning means move into the pipe line, wherein: (1) the cleaning means is brought into contact with an inner wall of the line; (2) a reduced pressure is established on opposite sides of the continuous annular gap; and (3) the cleaning means is made to move around about the cross-section of the line by twisting the supply conduit about its longitudinal axis.

2. Process in accordance with claim 1, wherein said annular gap of the cleaning means is brought into close contact with an inner wall of the line and that the pressure medium is made to discharge with a gap angle of 30–60 degrees relative to the longitudinal direction of the cleaning means.

3. Process in accordance with claim 2, wherein the cleaning means is made to assume an angle of 10–30 degrees against the inner wall of the line.

4. Cleaning arrangement for cleaning pipe lines, comprising a cleaning means in the form of a rear piece, and a front piece detachably mounted on the rear piece, the arrangement between the front piece and the back piece providing a nozzle opening in the form of a mainly continuous annular gap directed backwards towards a supply conduit at an acute angle towards a center line which extends through the fastening of a supply conduit in the cleaning means, and the cleaning means is connected to a source of pressure medium via the supply conduit, wherein the cleaning means has the general shape of a ball wherein the continuous gap extends along the outermost periphery of the cleaning means, said continuous gap is established by the back piece having an external conical surface extending along its periphery at its forward end, while the front piece has a conical internal surface corresponding to said back piece conical surface in order to, when used, establish said annular gap, and said annular gap being directed back out towards the coupling means at an angle of up to 30–60 degrees.

5. Cleaning arrangement in accordance with claim 4, wherein the breadth of the annular gap is regulatable by means of an annular washer, the thickness of which determines the breadth of the annular gap.

6. Cleaning arrangement in accordance with claim 4, wherein the front piece on the cleaning means presents a conical surface which extends from the annular gap and towards the top of the cleaning means at a cone angle of 10–40 degrees.

7. A cleaning device for cleaning pipes and tubes, said device comprising a cleaning means which can be connected to a supply conduit for a pressurized medium, said cleaning means comprising:

a fastening means for connecting said device to a supply conduit, said fastening means defining an orifice through which a pressure medium can pass, said orifice having a center line; and a nozzle means connected to said fastening means, said nozzle means comprising a nozzle head and an annular gap along the periphery of said nozzle head through which a pressure medium supplied through said fastening means can pass, wherein, when in use, said annular gap directs pressure medium in the form of a conical jet of pressurized medium, and said conical jet provides an annular, uninterrupted contact with the inner walls of a tube or pipe being cleaned and contacts substantially the entire inner walls when passing through a tube or pipe.

8. A cleaning device as in claim 7, wherein said annular gap further provides an expelled flow of pressurized medium which causes a higher pressure on one side of said annular gap than on the other side of said annular gap and forces said device in the direction of the side of said annular gap having a lower pressure.

9. A cleaning device as in claim 7, wherein said cleaning means has the general shape of a ball and the continuous gap extends along the outermost periphery of the cleaning means.

10. A cleaning device as in claim 7, wherein said cleaning device comprises a supply guide means and a deflection means which can be connected to form said cleaning device, said supply guide means and said deflection means each having an outer surface, and wherein said annular gap divides the outer surface of said supply guide means from the outer surface of the deflection means.

* * * * *